US006712249B2

(12) United States Patent
Magnusson et al.

(10) Patent No.: US 6,712,249 B2
(45) Date of Patent: Mar. 30, 2004

(54) BACKPACK ENTERTAINMENT SYSTEM WITH DETACHABLE POCKETS FOR SPEAKERS

(75) Inventors: Tony Magnusson, San Diego, CA (US); Brian Reid, San Diego, CA (US)

(73) Assignee: California Board Sports, Inc., San Diego, CA (US)

( * ) Notice: Subject to any disclaimer, the term of this patent is extended or adjusted under 35 U.S.C. 154(b) by 0 days.

(21) Appl. No.: 10/147,440

(22) Filed: May 15, 2002

(65) Prior Publication Data

US 2002/0176593 A1 Nov. 28, 2002

Related U.S. Application Data

(63) Continuation-in-part of application No. 09/777,232, filed on Feb. 5, 2001.

(60) Provisional application No. 60/180,491, filed on Feb. 5, 2000.

(51) Int. Cl.[7] ..... A45C 15/00

(52) U.S. Cl. ..... 224/576; 224/153; 224/652; 224/930; D3/216

(58) Field of Search ..... 224/576, 153, 224/583, 652, 930; D3/216, 217, 218, 270

(56) References Cited

U.S. PATENT DOCUMENTS

| | | | | | |
|---|---|---|---|---|---|
| 4,450,495 | A | * | 5/1984 | Naruki | 360/137 |
| 4,561,576 | A | | 12/1985 | Lowe et al. | |
| 4,589,134 | A | | 5/1986 | Waldron | |
| 4,744,398 | A | | 5/1988 | Clark | |
| 4,764,962 | A | | 8/1988 | Ekman et al. | |
| 4,876,724 | A | | 10/1989 | Suzuki | |
| 5,001,779 | A | * | 3/1991 | Eggert et al. | 455/346 |
| 5,004,105 | A | | 4/1991 | Freadman | |
| D351,943 | S | * | 11/1994 | Young | D3/216 |
| 5,395,023 | A | | 3/1995 | Naymark et al. | |
| 5,409,152 | A | | 4/1995 | Trevino | |
| 5,680,973 | A | * | 10/1997 | Vulpitta et al. | 224/153 |
| 5,897,042 | A | | 4/1999 | Sims | |
| 6,029,877 | A | | 2/2000 | Woods | |
| 6,279,796 | B1 | | 8/2001 | Trevino | |
| 6,354,477 | B1 | | 3/2002 | Trummer | |
| D469,952 | S | * | 2/2003 | Daglow et al. | D3/216 |

* cited by examiner

*Primary Examiner*—Stephen K. Cronin
(74) *Attorney, Agent, or Firm*—Wolff & Samson PC

(57) ABSTRACT

A backpack entertainment system with detachable speaker pockets is provided. The speaker pockets can be detached from the backpack and positioned separately therefrom to provide an enhanced stereo sound quality and/or ambience. Audio equipment within the backpack is connected to the speakers. The speaker pockets preferably comprise canvas or other like material, and can be quickly and easily attached to and detached from the backpack by zippers or other similar means.

12 Claims, 7 Drawing Sheets

BACKPACK ENTERTAINMENT SYSTEM WITH DETACHABLE POCKETS FOR SPEAKERS

This application is a continuation-in-part of U.S. patent application Ser. No. 09/777,232 filed Feb. 5, 2001, which application claims the benefit of U.S. patent application Ser. No. 60/180,491 filed Feb. 5, 2000, the entire disclosures of which are both incorporated herein by reference.

BACKGROUND OF THE INVENTION

1. Field of the Invention

The present invention relates to backpacks with audio entertainment systems associated therewith. More specifically, the present invention relates to a backpack entertainment system having audio equipment incorporated therein and having detachable pockets for speakers that allow for the speakers to be positioned away from the backpack to provide an enhanced stereo sound quality and/or ambience.

2. Related Art

Backpacks provide a convenient means for transporting objects from one location to another. Indeed, individuals frequently use backpacks to carry around everyday items such as books, sports equipment, etc., to various locations and/or events such as schools, camping trips, sporting events, etc. Backpacks allow items to be conveniently carried on the back of a person while freeing-up the person's arms and hands. However, while carrying a backpack, it is often desirable to carry a portable music system, such as a CD player, MD player, tape player, AM/FM radio, or the like. Typically, the portable music system is held separately. This requires one to hold the music system, thereby defeating the hands-free approach associated with a backpack. Alternatively, one can use a device such as a WALKMAN to listen to music, but headphones make the experience a private one as opposed to a shared one.

There have been a number of efforts by others to provide audio equipment associated with backpacks and clothes, but none provided detachable speaker pockets for easily and conveniently positioning the speakers in a manner to enhance the stereo sound quality.

Accordingly what would be desirable, but has not heretofore been provided, is a backpack entertainment system with speakers in detachable pockets which allow for the speakers to be positioned to provide an enhanced stereo sound quality and/or ambience.

OBJECTS AND SUMMARY OF THE INVENTION

It is an object of the present invention to provide a backpack entertainment system having pockets for speakers which pockets can be detached from the backpack to allow the speakers to be positioned to provide an enhanced stereo sound quality and/or ambience.

It is still another object of the present invention to provide a backpack entertainment system having detachable pockets for speakers that can be easily attached back to the sides of the backpack after use.

The present invention relates to a backpack entertainment system having detachable pockets for speakers. The backpack includes an audio amplifier and speakers connectable with a personal music device, such as a CD player, tape player, MD player, AM/FM stereo, or the like. The backpack includes sufficient interior room to allow a wearer to carry other desired items, such as books, folders, sports equipment, containers, etc., along with the audio entertainment system. The speakers are positioned in and connected to pockets along the sides of the backpack. The pockets are detachable from the backpack, to allow the speakers to be positioned away from the backpack to provide an enhanced stereo sound quality.

In an embodiment of the present invention, the speaker pockets are removably attached to sides of the backpack by zippers, so that the user can quickly unzip the speakers from the backpack and position same according to the user's tastes. The speakers can be positioned to face in any desired direction, and are attached to the amplifier by speaker wires extendable from the backpack. When finished, the user can re-attach the speaker pockets to the backpack by zipping same thereto.

BRIEF DESCRIPTION OF THE DRAWINGS

These and other important objects and features of the invention will be apparent from the following Detailed Description of the Invention taken in connection with the accompanying drawings in which.

DETAILED DESCRIPTION OF THE INVENTION

The present invention relates to a backpack entertainment system with detachable pockets for speakers that can be detached from the backpack and positioned to provide enhanced stereo sound quality. The backpack includes an amplifier connected to the speakers for allowing a personal music system, such as a CD, tape, or MD player, AM/FM stereo, or the like, to be connected therewith. The speakers can be attached to the amplifier by speaker wires that can be extended from the backpack to a desired length. The speaker pockets are preferably made of a material similar to the backpack to provide protection for the speakers and an overall uniform appearance. The speaker pockets are removably attached to the backpack by zippers or other similar attachment means.

Figure 1:
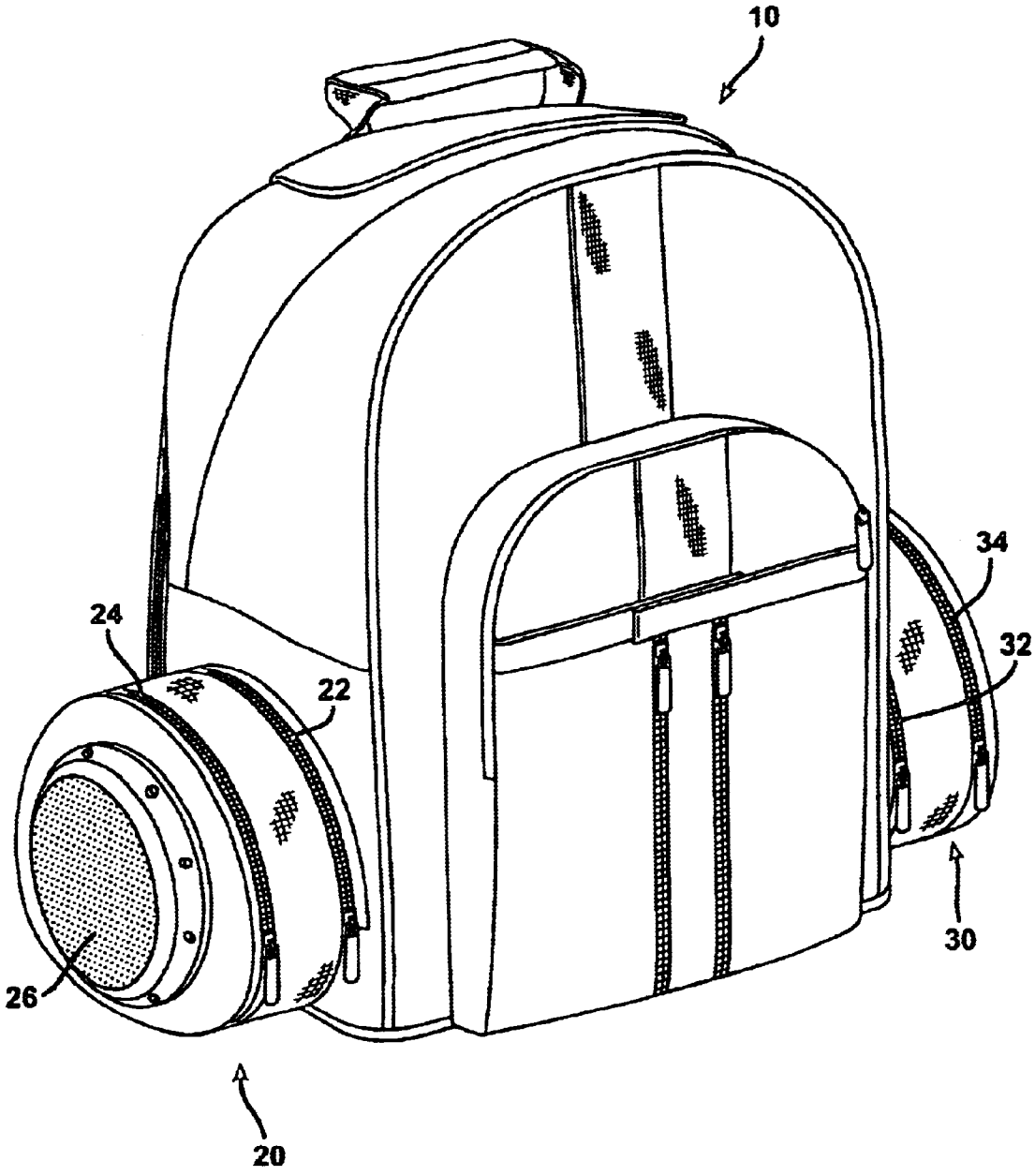
FIG. 1 is a perspective view of the backpack entertainment system of the present invention.

FIG. 1 is a perspective view of the backpack entertainment system of the present invention. Attached to backpack 10 are speaker pockets 20 and 30 which house speakers therewithin. Pockets 20 and 30 are removably attachable to the sides of backpack 10 according to a user's desires. Backpack 10 can be any backpack known in the art. In a preferred embodiment of the present invention, backpack 10 is manufactured from canvas or other similar material, and has sufficient internal room to allow an individual to carry a plurality of items, such as books, folders, sports equipment, containers, etc. Of course, backpack 10 can be manufactured from any material known in the art, and it is conceivable that speaker pockets 20 and 30 could be attached to backpack 10 at locations other than the sides thereof. A preferred backpack is disclosed in the co-pending parent patent application hereinbefore referenced.

Speakers pockets 20 and 30 are preferably made of the same material as backpack 10 to provide a uniform appearance when the speaker pockets are attached to the backpack, and to protect the speakers against damage. Further, speaker pockets 20 and 30 may optionally include additional zippers 24 and 34 that allow access to the interior of the speaker. Zippers 22 and 32 attach the speaker pockets 20 and 30 to the backpack 10, and allow a user to quickly and easily detach the speaker pockets 20 and 30 for positioning the speakers in any desired location. Other attachment means known in the art, such as hook-and-loop fasteners, buttons, clasps, or other similar devices, can be used to attach speaker pockets 20 and 30 to backpack 10 without departing from the scope of the present invention.

Figure 2:
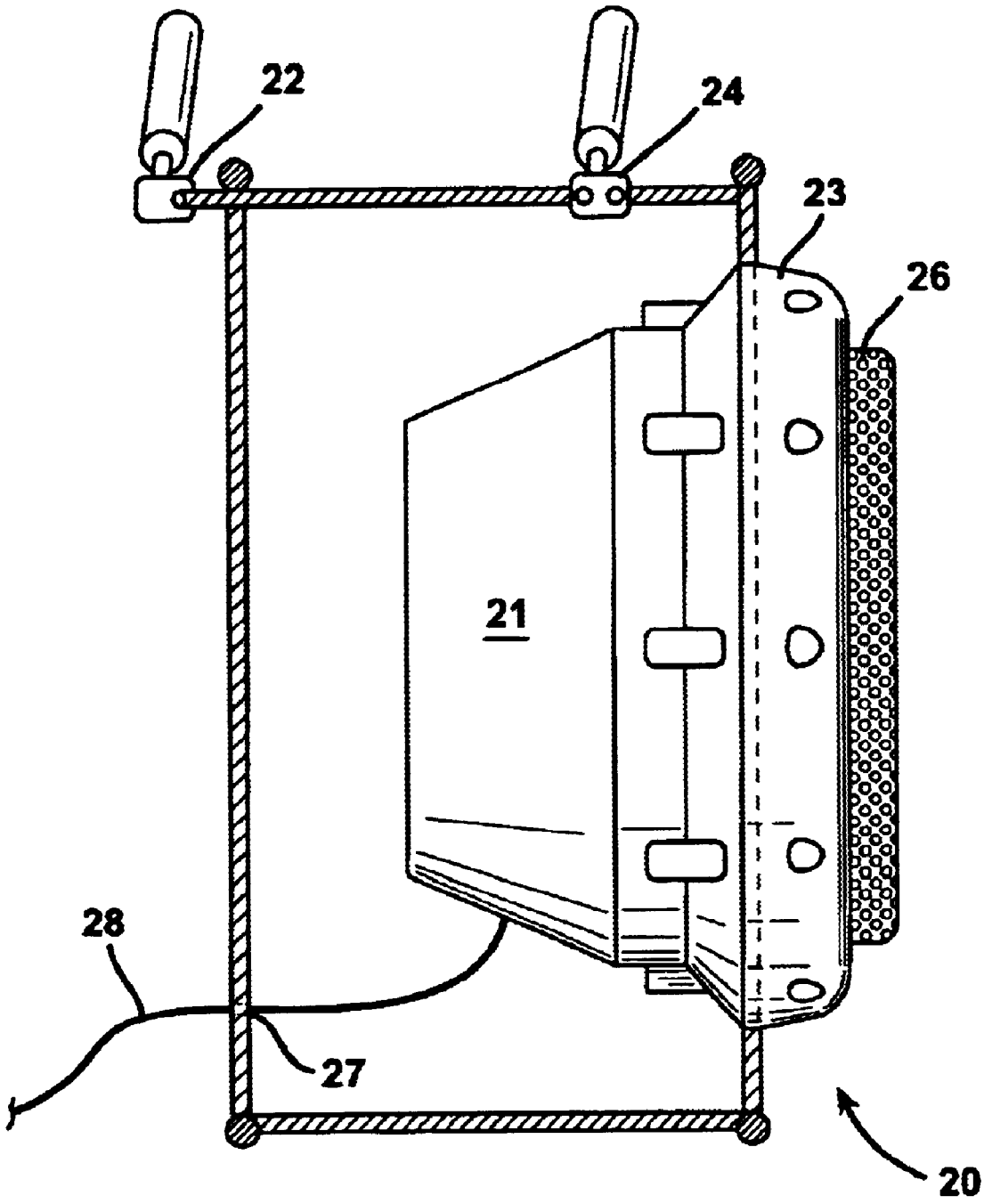
FIG. 2 is a partial sectional view of the speaker pocket with a speaker interconnected therewith.

Referring now to FIG. 2, the speakers 21 are positioned within and connected to an outer surface of the speaker pocket 20. The body of the speaker 21 is positioned within the pocket 20. The speaker grill 26 and surrounding attachment ring 23 are positioned on the exterior of the pocket 20 and are connected to speaker 21 by fasteners extending through apertures disposed about the perimeter of ring 23, through the pocket material and through corresponding receptacles disposed about the perimeter of speaker 21. Preferably the pocket includes an aperture aligned with the grill 26. As such, the speaker 21 is positioned within and connected to the pocket 20 and delivers sound through the grill 26 to the exterior of the pocket 20. Speaker wire 28 passes through aperture 27 and then into the backpack. Zipper 22 attaches pocket 20 to the backpack and zipper 24 allows access to the speaker 21 in the pocket 20.

Figure 3:
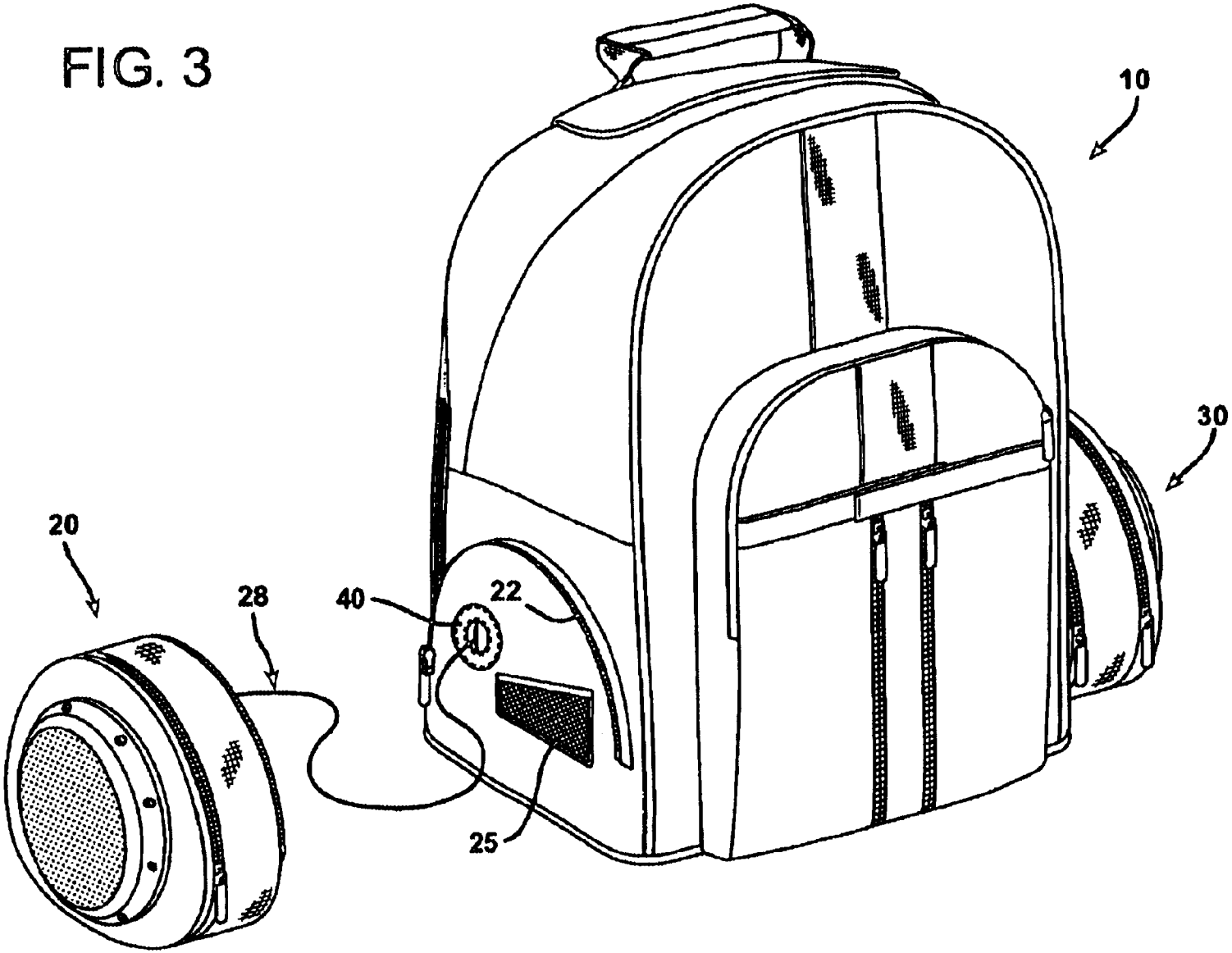
FIG. 3 is a perspective view of the backpack entertainment system of the present invention, showing one of the speakers detached from the backpack.

FIG. 3 is a perspective view of the backpack entertainment system of the present invention, showing the speaker pocket 20 of FIG. 1 detached from the backpack 10. As previously mentioned, each of speaker pockets 20 and 30 can be detached from the backpack 10 and the speakers can be positioned separately from the backpack to provide enhanced stereo sound quality. Speaker wire 28 connects the speaker in speaker pocket 20 to an amplifier contained within backpack 10, the speaker wire 28 entering backpack 10 via opening 40. In a preferred embodiment of the present invention, opening 40 allows the speaker wire 28 to enter the backpack 10, but prevents rain or other debris from infiltrating the interior of backpack 10 when the speaker pockets 20 and 30 are detached therefrom. The opening 40 is defined by circular aperture having a reinforcing ring or flexible grommet. A flexible material such as neoprene can be secured within the aperture. A slit in the neoprene allows the speaker wire 28 to pass through the aperture. A similar construction can be used to allow the speaker wire 28 to pass into the speaker pocket 20. Further, similar apertures can be positioned at an upper rear area of the backpack to allow for headphone cables to be passed to the interior of the backpack 10. A speaker wire 38 connects the speaker in speaker pocket 30 to an amplifier or other audio device stored within backpack 10, in the same manner as described for speaker wire 28.

The backpack 10 can include pockets such as mesh pockets 25 disposed on each side of the backpack to retain speaker wires 28 and 38 when the speaker pockets 20 and 30 are attached to backpack 10. Conceivably, the present invention could also include a device in backpack 10 for retracting the speaker wires 28, 38 thereinto via opening 40, when speaker pockets 20 and 30 are reattached to backpack 10. As can be readily understood, any means for spooling or otherwise retaining speaker wires 28, 38 could be included with backpack 10 without departing from the spirit of the present invention.

Figure 4:
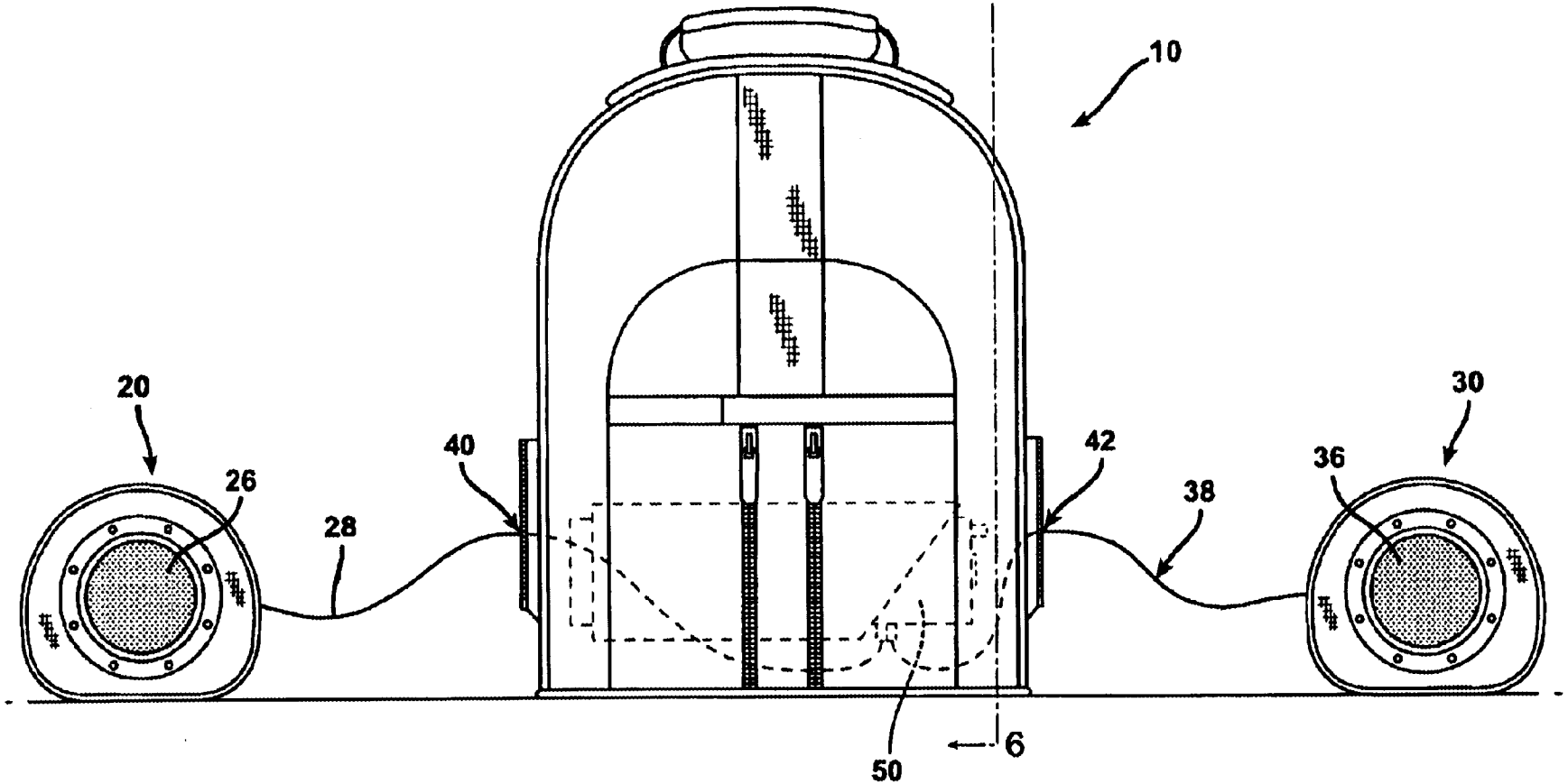
FIG. 4 is a front view of the backpack entertainment system of FIG. 1 shown in greater detail.

FIG. 4 is a front view of the backpack entertainment system of FIG. 1. As shown in FIG. 3, speaker pockets 20 and 30 are detached from backpack 10 and the speakers positioned separately from the backpack to achieve an enhanced stereo sound quality. The speaker wires 28 and 38 are extended from the backpack 10 via openings 40 and 42, respectively, and are connected to amplifier 50, which is shown in phantom and stored within backpack 10. Importantly, it is desirable that the backpack 10 contain sufficient room to allow a user to store desired items within backpack 10, such as books, sports equipment, and other items, in addition to audio equipment and the amplifier 50. As can be readily understood, the grilles 26 and 36 of speaker pockets 20 and 30, and hence the speakers, can be aimed in any desired direction to achieve any desired stereo sound effects without departing from the spirit of the present invention.

Figure 5:
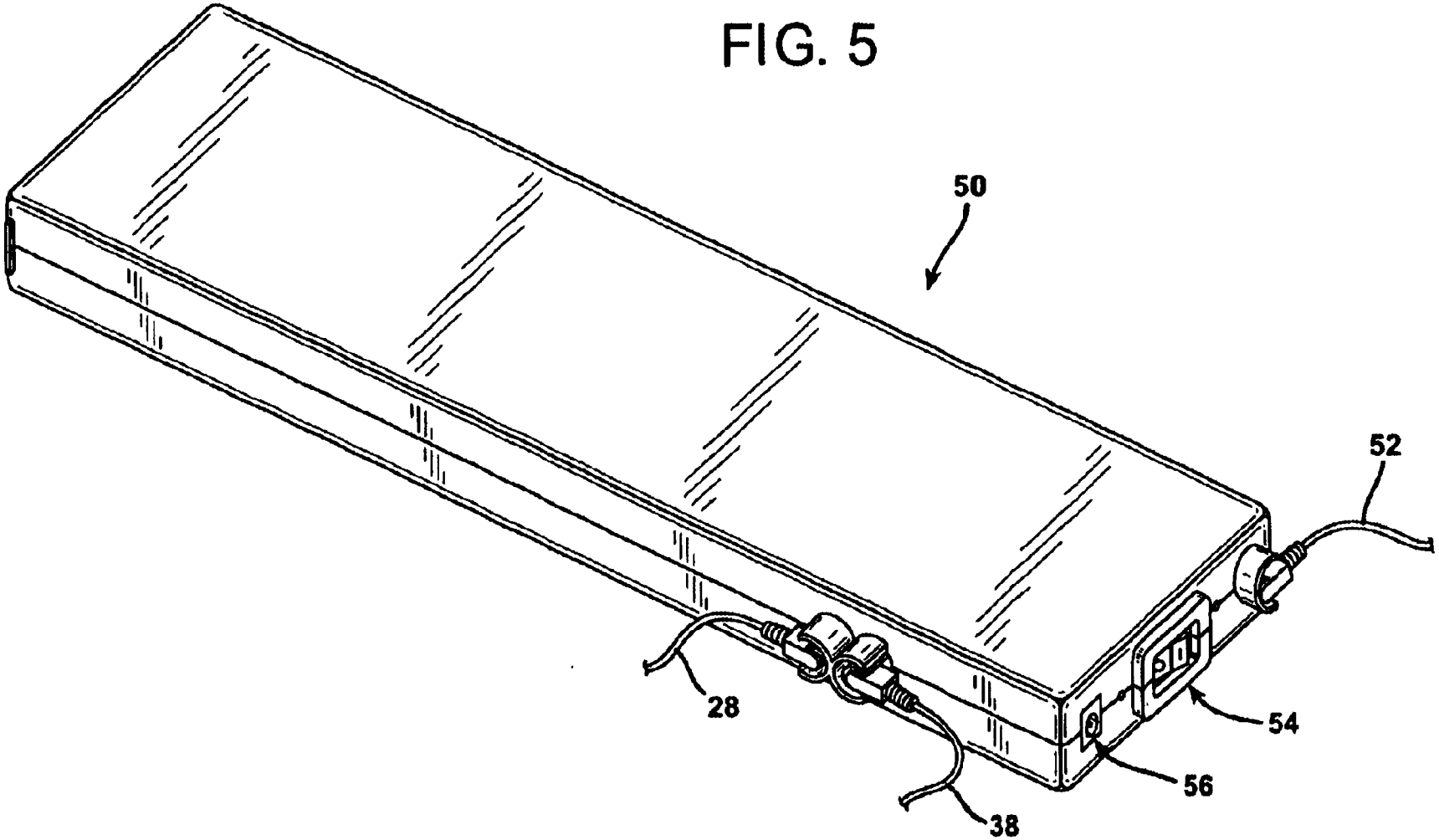
FIG. 5 is a perspective view of the amplifier of the present invention.

FIG. 5 is a perspective view of the amplifier of the present invention. Amplifier 50 can be any amplifier of any design suitable to provide sufficient power to drive the speakers at an acceptable volume level. Amplifier 50 comprises a patch cord 52 that allows connection of the amplifier 50 to a personal music system, such as a CD player, MD player, tape player, AM/FM stereo, MP3 player, or any other similar device known in the art. Further, amplifier 50 includes a switch 54 for controlling power to the amplifier, and a power jack 56 for connecting the amplifier 50 to an external power source (i.e., AC-to-DC wall adapter). To allow portability, amplifier 50 preferably includes batteries. Speaker wires 28 and 38 are removably connected with amplifier 50 via plugs and jacks, and allow connection to speakers in speaker pockets 20 and 30, respectively.

Figure 6:
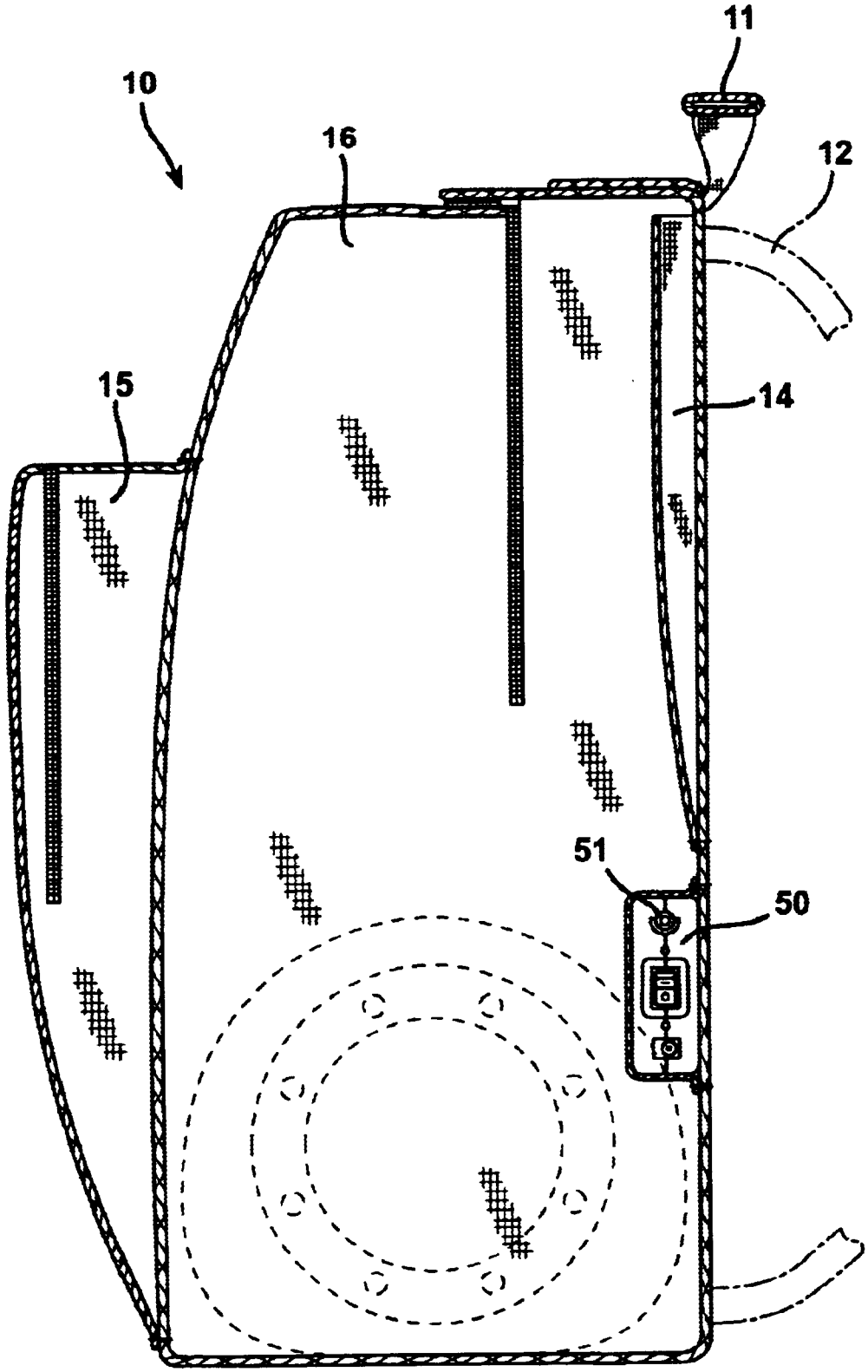
FIG. 6 is a cross-sectional view taken along line 6—6 of FIG. 3.

Referring now to FIG. 6, a cross-sectional view taken along line 6—6 of FIG. 3 is shown. As can be seen, the backpack 10 includes a handle 11 and straps 12. The amplifier 50 is positioned internally in the amplifier pocket 51. Speaker and speaker pockets are shown in phantom. Compartment 14 is provided for receiving audio equipment such as a CD player or other device. Compartment 14 is accessed through a zipper at an upper edge thereof and expands to accommodate equipment of various sizes. Similarly, front pocket 15 can be used to house audio equipment or other items to be carried in the backpack 10. Central compartment 16 can be used to hold items to be carried in the backpack 10 or can hold additional audio equipment. Apertures can be provided adjacent to pocket 14 for allowing headphone cables to pass into the backpack which headphones can be worn by a user to listen to the audio equipment while carrying the backpack 10.

Figure 7:
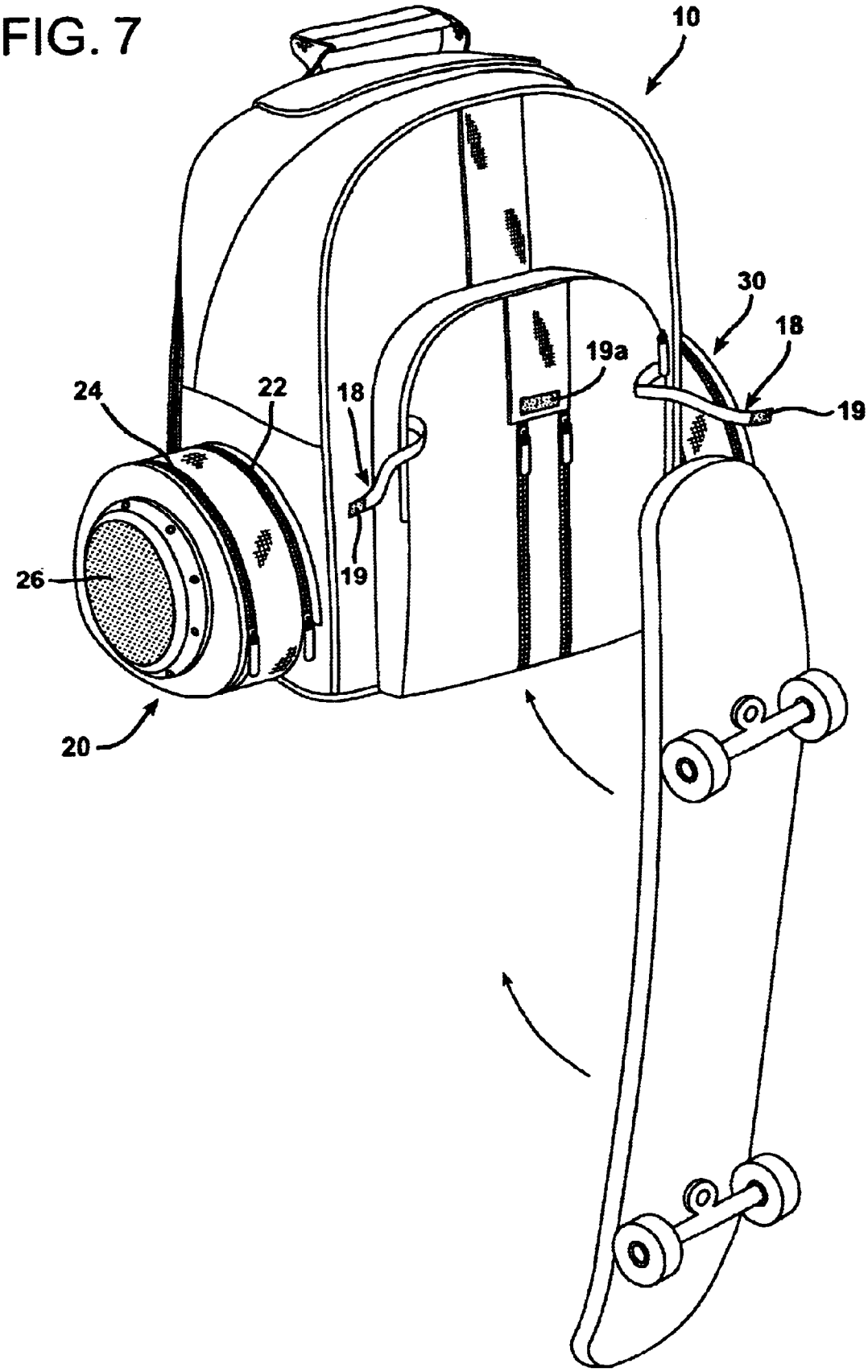
FIG. 7 is a perspective view showing the backpack of FIG. 1 and a skateboard which can be secured thereto.

FIG. 7 is a perspective view showing the backpack and a skateboard to be attached thereto. Straps 18 having attachment means thereon such as hook and loop fasteners 19 are attachable about a skateboard to secure a skateboard thereto. As can be seen, the straps 18 are positioned between the wheel assemblies to secure the skateboard to the backpack. The ends of the straps 18 can be detached to allow the skateboard to be removed from its connection to the backpack. Importantly, a central fastening member 19*a* is firmly secured to the backpack when not being used to carry a skateboard.

Having thus described the invention in detail, it is to be understood that the foregoing description is not intended to limit the spirit and scope thereof. What is desired to be protected by Letters Patent is set forth in the appended claims.

What is claimed is:

1. A portable entertainment system comprising:

a backpack;

audio equipment within the backpack;

speaker pockets on the exterior of the backpack for housing speakers;

speakers positioned within the speaker pockets; and means for removably attaching the speaker pockets to the backpack.

2. The system of claim 1, wherein the audio equipment comprises means for amplifying the speakers.

3. The system of claim 1, wherein the means for removably attaching the speaker pockets to the backpack comprises zippers for removably attaching the speakers to the backpack.

4. The system of claim 2, further comprising speaker wires for connecting the speakers to the audio equipment within the backpack.

5. The apparatus of claim 4, further comprising means for retracting or retaining the speaker wires when the speaker pockets are attached to the backpack.

6. The system of claim 1, further comprising a grille attached to the housing for protecting the speaker.

7. The system of claim 1, wherein the speaker wire further comprises a plug for removably connecting the speaker to an amplifier or personal music device stored within the backpack.

8. The system of claim 1, further comprising a second zipper for allowing access to an interior of the housing.

9. The system of claim 1, wherein the housing comprises canvas. the speaker.

10. A method of providing music comprising:

providing a backpack having audio equipment therein;

providing speaker pockets removably attached to the backpack, the speaker pockets having speakers located therein;

detaching the speaker pockets from the backpack;

positioning the speakers at desired locations; and playing music from the portable music system through the speakers.

11. The method of claim 10, further comprising reattaching the speaker pockets to the backpack after playing the music.

12. The method of claim 11, wherein the step of reattaching the speaker pockets comprises zipping the speaker pockets to the backpack.

* * * * *

UNITED STATES PATENT AND TRADEMARK OFFICE

CERTIFICATE OF CORRECTION

PATENT NO. : 6,712,249 B2
DATED : March 30, 2004
INVENTOR(S) : Tony Magnusson and Brian Reid It is certified that error appears in the above-identified patent and that said Letters Patent is hereby corrected as shown below:

Column 6,
Line 8, please delete the words "the speaker."

Signed and Sealed this

First Day of June, 2004

JON W. DUDAS
*Acting Director of the United States Patent and Trademark Office*